US005353965A

United States Patent [19]

Lee

[11] Patent Number: 5,353,965

[45] Date of Patent: Oct. 11, 1994

[54] CONTAINER FOR DISPENSING CONDIMENTS

[76] Inventor: Gary K. Lee, 5827 S. 81st East Pl., Tulsa, Okla. 74145

[21] Appl. No.: 146,405

[22] Filed: Nov. 1, 1993

[51] Int. Cl.[5] ..... B67D 5/60; B67D 5/06

[52] U.S. Cl. ..... 222/143; 222/181; 222/482; 222/543

[58] Field of Search ..... 222/143, 181, 462, 481, 222/482, 543

[56] References Cited

U.S. PATENT DOCUMENTS

| | | | |
|---|---|---|---|
| 297,174 | 4/1884 | Seymour | 222/482 X |
| 1,761,164 | 6/1930 | Wilson | 222/482 |
| 2,560,761 | 7/1951 | Ferguson | 222/143 X |
| 2,838,211 | 6/1958 | Piker | 222/543 X |
| 2,889,089 | 6/1959 | Herrick et al. | 222/543 X |
| 3,159,320 | 12/1964 | Scholtz | 222/482 X |
| 3,325,031 | 6/1967 | Singier | 222/215 |
| 3,378,177 | 4/1968 | Guan | 222/482 |
| 3,545,651 | 12/1970 | Lewis | 222/181 |
| 3,603,366 | 9/1971 | Albizati et al. | 150/0.5 |
| 4,207,990 | 6/1980 | Weiler et al. | 220/267 |
| 4,298,045 | 11/1981 | Weiler et al. | 150/0.5 |
| 4,773,569 | 9/1988 | Larsson | 222/181 |
| 4,781,314 | 11/1988 | Schoonover | 222/465.1 |
| 4,946,075 | 8/1990 | Lundbäck | 222/181 |
| 5,123,554 | 6/1992 | Arvidson et al. | 215/12.2 |
| 5,141,136 | 8/1992 | Tignor | 222/212 |

*Primary Examiner*—Andres Kashnikow
*Assistant Examiner*—Kenneth Bomberg
*Attorney, Agent, or Firm*—Catalano, Zingerman & McKay

[57] ABSTRACT

A bottle which may be in a straight-up position for storage and in an inverted position for dispensing of condiments, such as ketchup, mayonnaise, mustard, etc. The top has a cap which may be removed and replaced by a dispensing nozzle. The bottom has two parallel ridge members and has a hole in the flat area therebetween that is closable with a tethered plug. When the bottle is ready to be used for dispensing condiments, the cap is replaced with the dispensing nozzle and the bottle is turned upside down. At this time, the tethered plug is removed so as to release pressure in the bottle so its contents may escape through the dispensing nozzle. The bottle is of shape and weight so that when inverted and hung on a stand, it will hang properly perpendicular to the ground. The bottles are also shaped so that they will nestle against one another with very little clearance. The bottle can be filled with condiments, inverted for dispensing through the dispensing nozzle, and the plug from the vent hole is removed when the bottle is hung upside down and is used. At the end of the day, the tethered plug is placed in the vent hole, and the bottles are then placed up so they can be stored in refrigeration units.

5 Claims, 2 Drawing Sheets

CONTAINER FOR DISPENSING CONDIMENTS

BACKGROUND OF THE INVENTION

This invention is directed to containers for dispensing condiments and especially to a container which can be inverted for dispensing the condiments and inverted to its upright position for storage. One dispenser for mustard and ketchup is described in U.S. Pat. No. 4,773,569 to Larsson. It shows a cylindrical container which has a dispensing nozzle attachable at the neck of the bottle. Condiments such as mustard, mayonnaise, ketchup, etc. are required for any successful restaurant and especially for a fast food restaurant. Many of the fast foods restaurants have their condiments in small sealed plastic envelopes. When they are to be used, the end of the envelope is torn and the condiments squeezed out. This invariably is messy. There is thus a need for a more efficient container for dispensing condiments.

It is therefore an object of this invention to provide a container for dispensing condiments that can be inverted any number of times between upright and inverted positions and which can be nestled together.

SUMMARY OF THE INVENTION

This condiment container is capable of a straight up or upright position for long-term storage or an inverted position for dispensing condiment. The container is rectangular in cross-section and has a bottom upon which it may rest in the upright position and a neck at the top (relative to the upright position) for attaching a dispensing nozzle. The bottom is provided with two parallel base members with a vertically positioned rib perpendicular to the bottom between the two base members. The rib has a first hole in the center of the rib which is on the axis of the center of gravity and is used for attaching a hook to hold the container in an inverted position. The rib has a second hole from which a tethered plug is supported. A vent hole is provided in the bottom, and the tethered plug seals the vent hole. The tethered plug can be removed or inserted as required when the neck is at the top or higher position; and when the container is resting on its bottom, it is in the upright position. When the neck is in the lower position, it is inverted.

The container is so designed that when in the inverted position the bottle will hang in a perpendicular position relative to the ground. The containers are rectangular in cross-section so that they will nestle against one another when a plurality are hung together in the inverted position in the stand. Typically the bottles are in one-half gallon and one gallon sizes and are designed to be of the same width, but different depths. This ensures that they will nestle properly against one another when hung on a rack or rod regardless of the volume of the container.

The top of the bottle, when in the upright position, contains a neck portion which is threaded to either receive a sealing cap for storage or dispensing nozzle in the inverted position.

When the container is being stored or shipped, it is positioned with its bottom on a supporting shelf, and the neck end is in the upright position. When in this position, the bottle has the cap on the neck and the tethered plug is in the vent hole. When it is desired to use the container for dispensing condiments, it is removed from storage, the cap is removed from the neck, the dispensing nozzle is placed thereon, and the bottle inverted.

Then the vent plug is removed from the vent hole and the fact that it is tethered to the support member makes the plug always available. The bottle is then hung from the first support hole in the rib member. When the container and its contents are to be stored, such as at night, the dispensing nozzle is preferably removed and the cap replaced on the neck of the bottle. The plug which is tethered, and is always available and never lost, is then inserted into the vent hole. The bottle is then removed from the vertical hanging position and inverted to its original upright position with the bottom resting on the storage shelf. If the vent hole were not sealed, the condiments would ooze out and create a messy situation.

It is therefore an object of this invention to describe a condiment container which can be stored in an upright position with the neck at the top and which can be positioned in an inverted position with the neck at the bottom and the bottle suspended from the bottom of the container and have a closeable vent hole for equalization of pressure. Other objects and a better understanding of the invention can be had from the following description taken in conjunction with the drawings in which:

DETAILED DESCRIPTION OF THE PREFERRED EMBODIMENT

Figure 1:
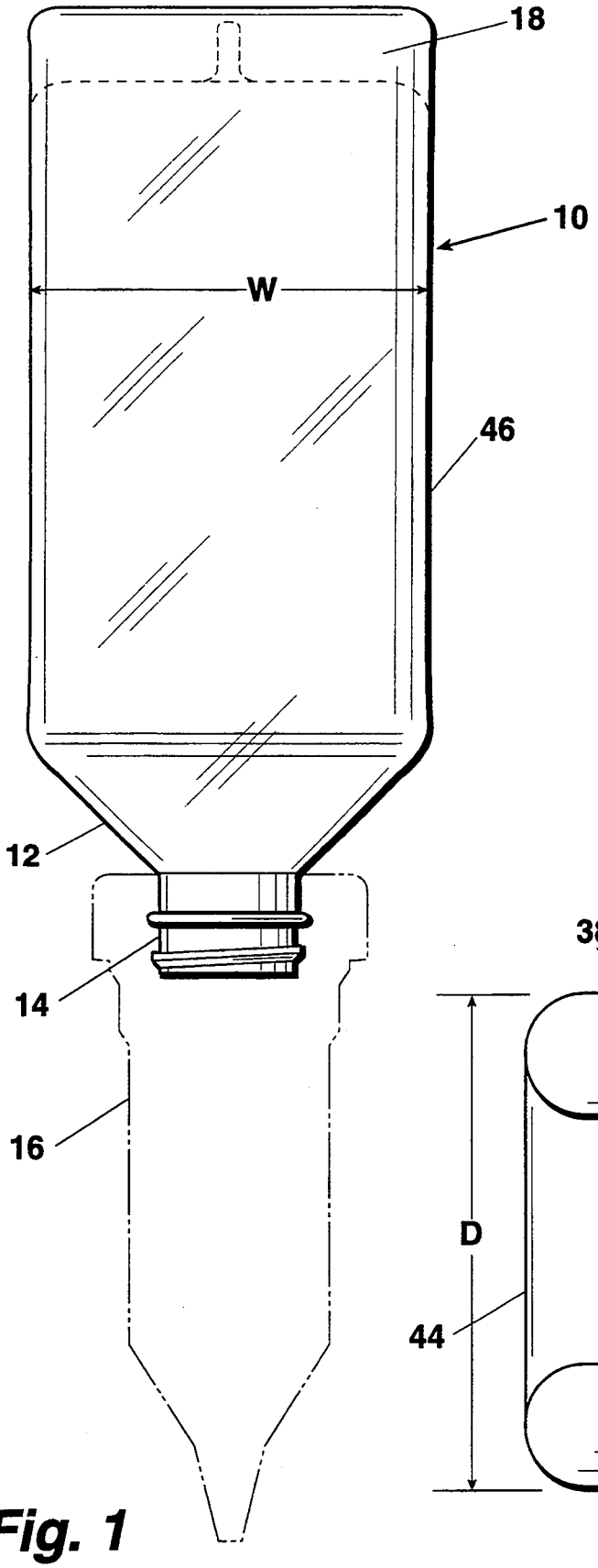
FIG. 1 illustrates the container of my invention in an inverted position.

Attention is next directed to the drawing which shows the bottle or container of this invention.

Figure 2:
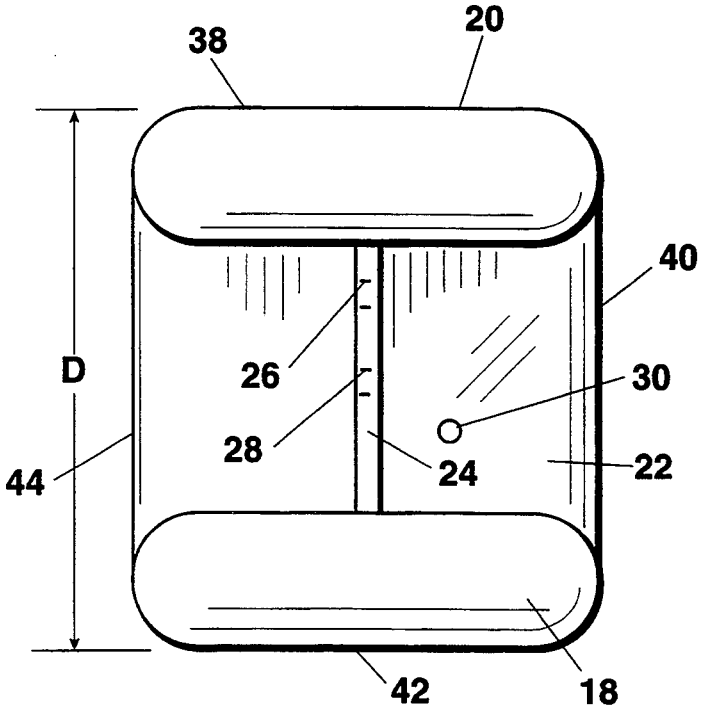
FIG. 2 illustrates the bottom of the container of FIG. 1.

Shown in FIG. 1 is a bottle 10 in inverted position having a tubular portion 46 and a neck portion 12 with a threaded connector 14 at the lower end thereof. A dispensing nozzle 16, shown in phantom, is provided. The shape of the bottle 10 can be more clearly shown or seen in FIG. 2 which shows that it has a first side 38, a second side 40, third side 42, and a fourth side 44. The sides are representative of a section taken perpendicular through the bottle 10 and shows that there are four equal sides so that the tubular member portion 46 is in effect a square in cross-section. Although a square has been shown, other modifications would permit this to be rectangular, in which the one dimension or the depth is greater or is different than the width. The width is shown as W in FIG. 1 and the depth is D as shown in FIG. 2.

The bottle in FIG. 1 is shown in the dispensing position. In this position the bottom area 22 as shown in FIG. 2 is at the upper end. This bottom portion contains two parallel ridge members 18 and 20. It is on these ridge members that the bottle rests when it is in its original or storage position with the neck 12 in the upper position. Between ridge members 18 and 20 is a web 24 perpendicular to the ridge member as can be seen clearly in FIGS. 2 and 4. Web 24 has a hanging hole 28 which is in the center of the configuration as shown clearly in FIGS. 2 and 4. It is by this hole that the bottle 10 is hung when it is in its dispensing mode as illustrated in FIG. 1. A second hole is shown in web 24.

Figure 3:
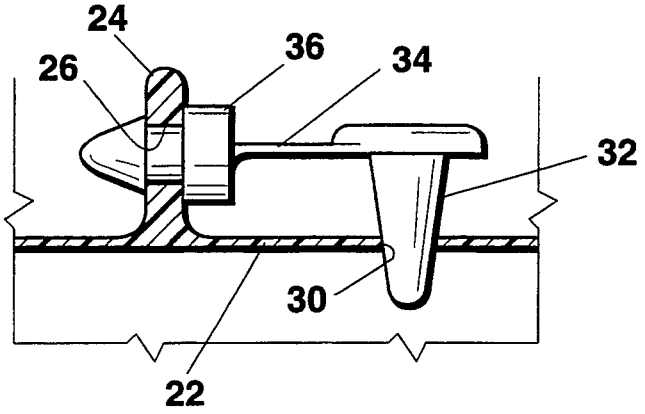
FIG. 3 illustrates the vent hole in the bottom with a tethered plug.

This is an anchor hole 26 which is positioned to one side of the hanging hole 28. Also shown in bottom area 22 is a vent 30. This hole permits the air to enter when the bottle is in the position shown in FIG. 1 so that the contents can flow more easily out of the dispensing nozzle 16. This equalizes the pressure between the inside and outside of the container. As shown in FIG. 3, there is a tethered plug 32 which closes the vent 30. This tethered plug is connected to anchor 36 in web 24 by tether or band 34. This tether 34 prevents the plug 32 from being lost when it is removed from the vent hole 30.

Figure 4:
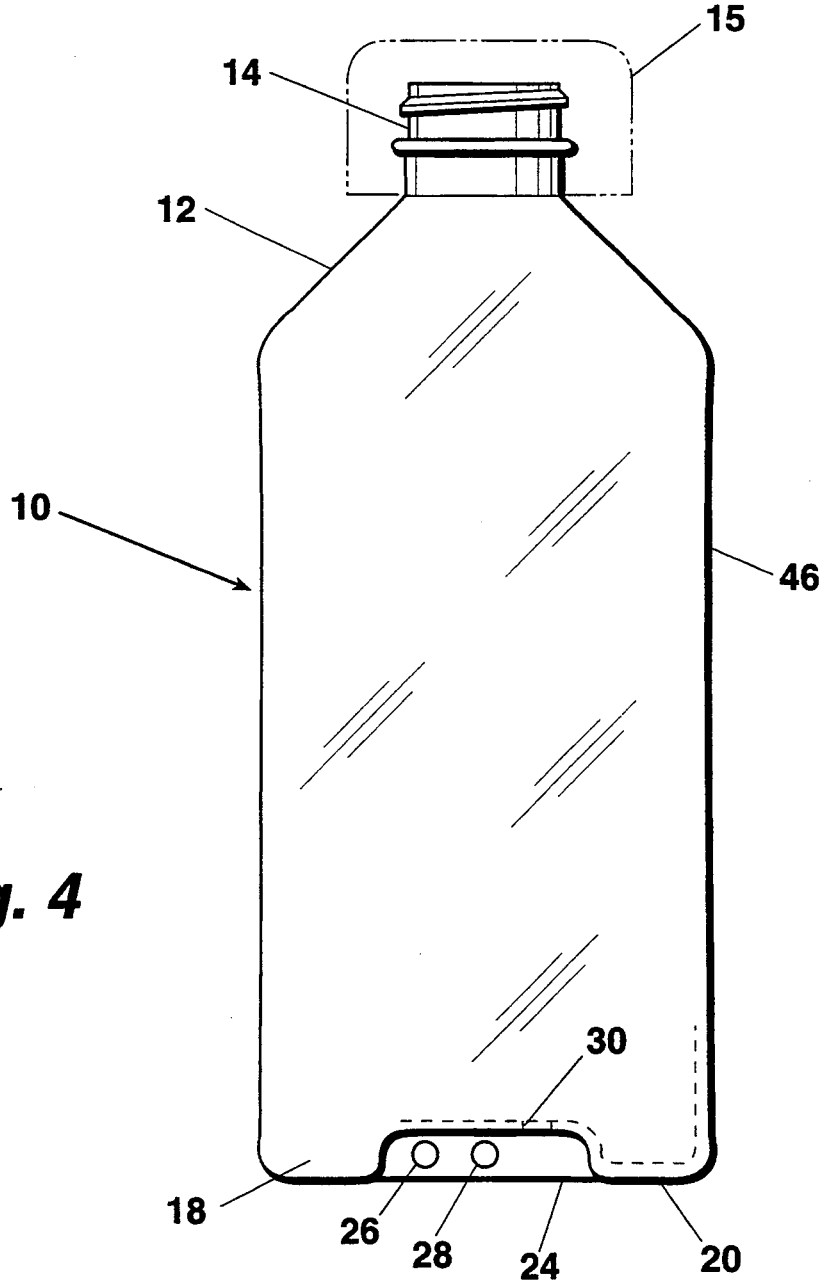
FIG. 4 is similar to FIG. 1 except that the container has been rotated 90 degrees and is in an upright position.

A few comments will be now made about the use of the bottle just described. As shown in FIG. 4, the bottle is in its normal upright position which it is when it is being stored in a refrigerator, for example. It has a cap 15 on thread 14. This device is square and the sides are smooth, both inside and out, so that it will aid in the dispensing of the condiments. When in this position, the bottle rests on ridge members 18 and 20. It will be assumed at this point the bottle is filled with whatever condiment is desired, such as mustard or ketchup. When it is desired to use this device for dispensing, the cap 15 is removed, and a dispensing nozzle 16 is placed thereon. Suitable dispensing nozzles are commercially available. The device is then turned upside down and hung from a hanging hook or the like through hole 28 in web 24. This holds the device in an inverted dispensing position. The bottle is shaped and weighted so that it will hang in perpendicular relation to the ground. In order to permit the condiment to flow easier, the tethered pug 32 is removed from vent hole 30. The tethered plug, when removed, allows equalization of pressure when the bottle is inverted. This permits the contents of the bottle to more readily be discharged.

At the end of the day or when the bottle is no longer needed and it is desired to shelve it or store it, one merely removes the bottle from the hanging hook after placing the tethered plug 32 into vent 30. This will permit the bottle to be turned up to its original position without losing the contents through this vent hole. The dispensing nozzle 16 would normally be removed and replaced by a cap 15. The recapped, unvented bottle is then placed in storage. The bottles can be placed in storage close to each other with very little space therebetween so very little storage space is wasted.

The space provided for hanging the bottles, when in the dispensing mode, usually has a set length or rod of definite length along which the inverted bottles will hang. It is usually felt desirable to have a selected number (X) of bottles occupy this rod. By having these bottles all the same width, the space can be designed so that X number of bottles will fit in there snugly. However, sometimes it is desired to have different volume bottles because of the difference in usage of the different condiments. This can readily be accommodated by this invention. Make a plurality of bottles having a width W which is the same for each. However, the depth D can vary to vary the volume of the individual bottles but keep the total combined widths of the bottles constant. If I wish to have a gallon bottle whereas the normal size when W equals D is a half-gallon, then all I have to do to make a gallon bottle is to make it have a depth D which is twice the width W.

It is clear then by use of this invention one can provide a bottle that can be filled with condiments, inverted for dispensing with the plug removed, condiments used, then at the end of the day the vent is sealed and the bottle placed straight up in a refrigeration unit. The shape of the bottle allows several bottles of various volumes to be used in a dispensing cabinet of a fixed width. With the tethered plug, one always has the plug available for closing the vent 30. That is, the plug is never lost. Further, by having the bottles all being rectangular in cross-section and all having the same width, bottles in one-half gallon and one gallon sizes can be used and will nestle properly regardless of the volume.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A container for dispensing condiments which comprises:

a bottle having a tubular section, a neck section, and a bottom and in which the tubular section has smooth walls and is rectangular in cross-section and has a width W and a depth D, said neck having a threaded extension adapted to be alternately closed by a cap and placed in an operating condition with a dispensing nozzle;

said bottle including on its bottom parallel ridge members and a web connecting the two members in the centerline of said bottom, said web having a first hanging hole in the center thereof;

said bottom having a vent hole between said ridge members;

a tethered plug for opening and closing said vent hole, said tethered plug tethered to said web.

2. A container as defined in claim 1 including a second container in which W of each container is the same but D is different.

3. A container as defined in claim 1 in which said web has a hole therein and an anchor in said hole to which the tether of the tethered plug is connected.

4. At least two condiment dispensing containers, each said container having a bottom, a rectangular tubular section having a width W and depth D, and a neck;

said bottom including parallel side members with base space therebetween, a web on the base space perpendicular to the side members and passing through the center of said bottom area, a hanging hole in said web at the center thereof, a vent hole in said bottom, a tethered plug for opening and closing said vent, a tether connecting said tethered plug to said web;

the interior of the tubular section and neck of said containers being smooth without ridges.

5. A device as defined in claim 4 in which in at least one of said containers, D is different from W, but in which W is the same for each container.

* * * * *